US006880610B1

(12) United States Patent
Bush

(10) Patent No.: US 6,880,610 B1
(45) Date of Patent: Apr. 19, 2005

(54) DRIVE FOR MULTIPLE SUSPENDED DOORS

(76) Inventor: Harold D. Bush, P.O. Box 568, Eagle Creek, OR (US) 97022

( * ) Notice: Subject to any disclaimer, the term of this patent is extended or adjusted under 35 U.S.C. 154(b) by 0 days.

(21) Appl. No.: 10/336,926

(22) Filed: Jan. 7, 2003

(51) Int. Cl.[7] ..... E05D 15/12
(52) U.S. Cl. ..... 160/202; 160/118; 49/138
(58) Field of Search ..... 49/138, 360; 160/222, 160/118, 197, 202

(56) References Cited

U.S. PATENT DOCUMENTS

| | | | | | |
|---|---|---|---|---|---|
| 987,123 | A | * | 3/1911 | Fleischer | 210/329 |
| 1,681,545 | A | * | 8/1928 | Lang | 49/102 |
| 1,960,860 | A | * | 5/1934 | Allen | 160/188 |
| 2,373,023 | A | * | 4/1945 | Goodwin | 49/102 |
| 2,425,016 | A | | 8/1947 | Weaver | |
| 2,468,453 | A | * | 4/1949 | Bernar | 160/331 |
| 2,553,738 | A | * | 5/1951 | Anderson | 49/65 |
| 2,658,571 | A | | 11/1953 | Guth et al. | |
| 2,875,832 | A | | 3/1959 | Clark | |
| 3,120,683 | A | | 5/1962 | Harris | |
| 4,073,092 | A | * | 2/1978 | Williams | 49/127 |
| 4,306,332 | A | * | 12/1981 | Simmons | 16/96 D |
| 4,785,485 | A | * | 11/1988 | Etesam | 4/557 |
| 4,791,757 | A | * | 12/1988 | Orlando | 49/360 |
| 5,282,663 | A | * | 2/1994 | Horton | 296/155 |
| 5,347,755 | A | * | 9/1994 | Jaster et al. | 49/25 |
| 5,381,846 | A | * | 1/1995 | Lichy | 160/273.1 |
| 5,839,543 | A | * | 11/1998 | Chiu | 187/324 |
| 6,085,826 | A | * | 7/2000 | Maesaki | 160/345 |
| 6,352,097 | B1 | | 3/2002 | Kern et al. | |
| 6,360,487 | B1 | | 3/2002 | Kern et al. | |
| 6,442,900 | B1 | * | 9/2002 | Kvasnes | 49/409 |

* cited by examiner

*Primary Examiner*—Gregory J. Strimbu
(74) *Attorney, Agent, or Firm*—James D. Givnan, Jr.

(57) ABSTRACT

A door system having first and second sets of panels with each set having leading and trailing panels, and having a different width. The leading panel of the first set includes a stop and the leading panel of the second set includes a pair of stops. First and second cable runs connected to a motor for driving the first and second sets of panels. The first cable run includes a clamp disposed within the stop of the leading panel of the first set and the second cable run includes a clamp disposed between the pair of stops of the leading panel of the second set. The space between the clamp of the second cable run and the pair of stops provides for a delayed engagement of the clamp of the second cable run with one of the pair of stops during initial movement of the second cable run. Notwithstanding the delayed engagement, the first and second sets of panels arrive at their full open positions simultaneously. Each set of panels includes a latch to connect the leading and trailing panels. The first and second sets of panels may also have equal widths.

6 Claims, 5 Drawing Sheets

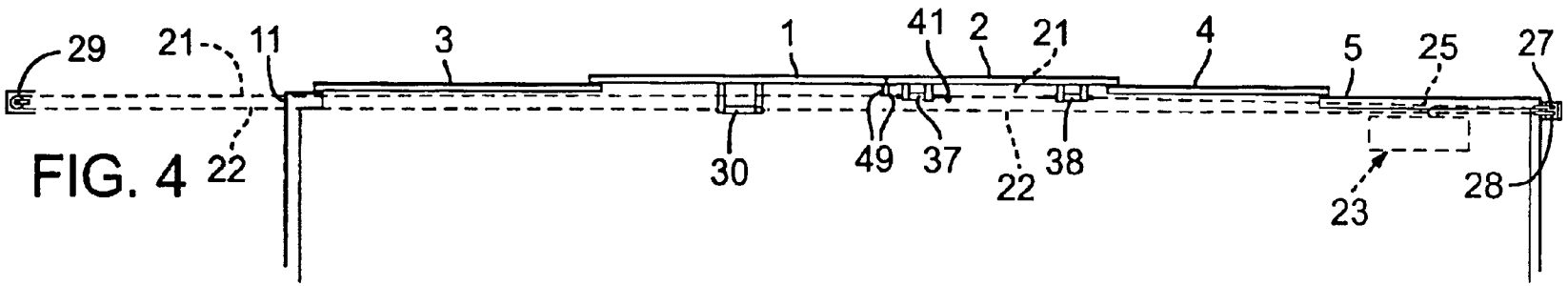
FIG. 4
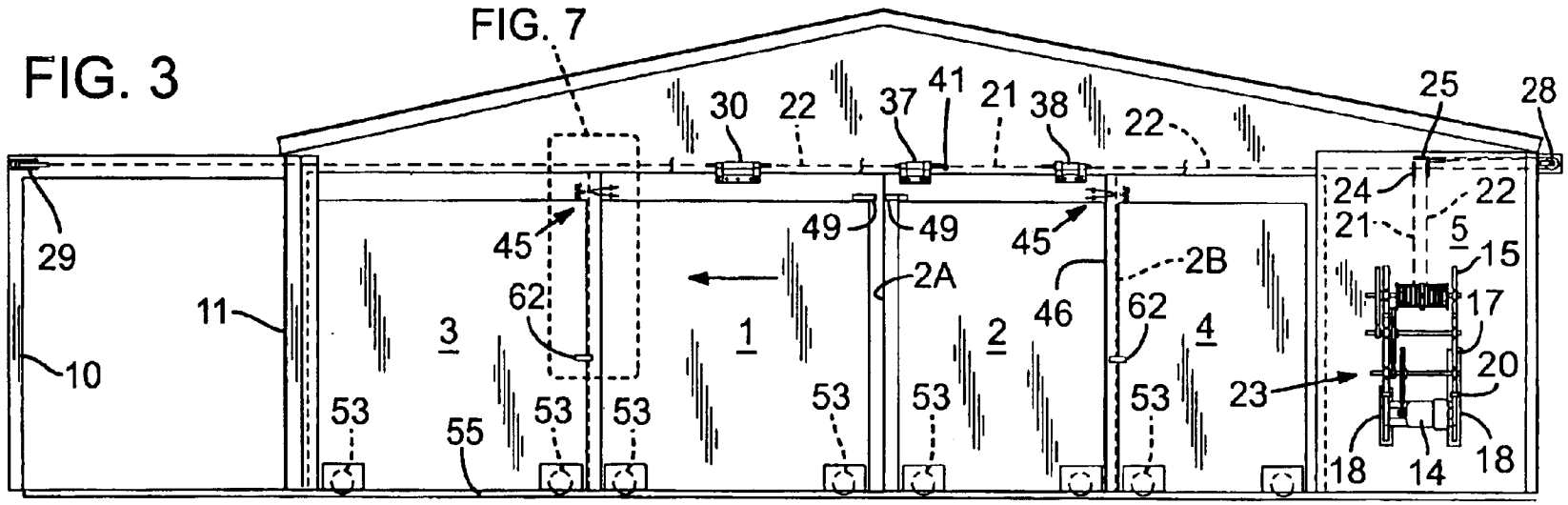
FIG. 7
FIG. 3

DRIVE FOR MULTIPLE SUSPENDED DOORS

BACKGROUND OF THE INVENTION

The present invention concerns a drive for the doors of a building of frame construction.

In wide use throughout the western United States are buildings, termed "pole buildings", which serve primarily as storage structures for providing a large covered area for farm equipment and the storage of feed and supplies associated with farming. Such buildings are of low cost per square foot of construction and have large door openings enabling the storage of equipment including tractors, farm machinery and even light aircraft. The buildings are of light frame construction with wooden trusses and an exterior of corrugated sheet metal. The doors of such buildings comprise multiple panels in pairs suspended for travel into an open position whereat the panels overlap one another adjacent opposite sides of the building doorway. In view of such building being of frame construction the doors are necessarily of light weight construction but require considerable effort to open and close. Further complicating driven doors in such buildings is that the door panels are often of non-uniform width with travel of the sets of panels being unequal. An objective of the present invention is to position the door sets, of different widths and travel, to their open and their closed positions simultaneously.

A further problem with known powered door systems for buildings in general is the original cost of such systems which is a significant factor in the overall cost of building construction.

U.S. Pat. No. 6,352,097 discloses a door with multiple panels including sets each of two panels which move in sequence to open a building doorway. The panels are suspended from overhead rails. Travel in opposite directions is imparted to the two leading doors by parallel cable runs. Travel is imparted to each trailing door by a "bumper" carried by a pair of pulleys on a continuous element engaging a stop on a wall.

U.S. Pat. No. 2,878,532 is also of interest in that it discloses a pair of doors which move in unison along a track in opposite directions with the opening mechanism including a pair of slides. Of particular interest is a mechanism for disengaging one door from the drive mechanism to permit separate positioning of a door by manual effort.

U.S. Pat. No. 2,425,016 discloses multiple panels of a door which are interconnected by an auxiliary drive system for imparting trailing movement to a second and third panel of a door.

U.S. Pat. No. 3,120,683 discloses hanger doors fully supported by parallel tracks with grooved rollers entrained on the tracks.

SUMMARY OF THE PRESENT INVENTION

The present invention is embodied in a drive for the multiple panels of a building door which open toward opposite sides of the building front for storage in a juxtaposed manner. A motor and gear reduction unit drive cable runs fitted with clamps, at spaced locations, for contact with impact absorbing stops on the panels to cushion the impact of the clamps. Movement of one set of panels may exceed the travel of a remaining or second set of panels which is compensated for by setting of the clamps. At least one of the suspended panels of the door includes a latch which cooperates with a fixed member to permit individual opening and closing of a single door panel providing for the passage of lesser sized objects. The lock is automatically actuated during door closing.

Important objectives of the present invention is the provision of a door operating drive suitable for installation in new or existing frame buildings being built or retrofitted and having a door with multiple panels which open and close in a progressive manner with sets moving in opposite directions; the provision of a door drive for the retrofitting of a building heretofore having manually positioned door panels; the provision of a low cost drive positioning the panels of a door without requiring costly alteration of the building; the provision of a drive for multiple door panels of a building which permits one of the panels to be manually opened and closed and locked without movement of the remaining panels; the provision of a drive for two sets of leading and trailing panels which panels may be of non-uniform width or of dissimilar travel to stowed positions or a combination of both.

BRIEF DESCRIPTION OF THE DRAWINGS

In the accompanying drawings:

FIG. 3 is an elevational view of the back side of the door panels closing a doorway;

FIG. 4 is a plan view of FIG. 3 with the building roof structure removed;

DETAILED DESCRIPTION OF THE PREFERRED EMBODIMENTS

Figure 1:
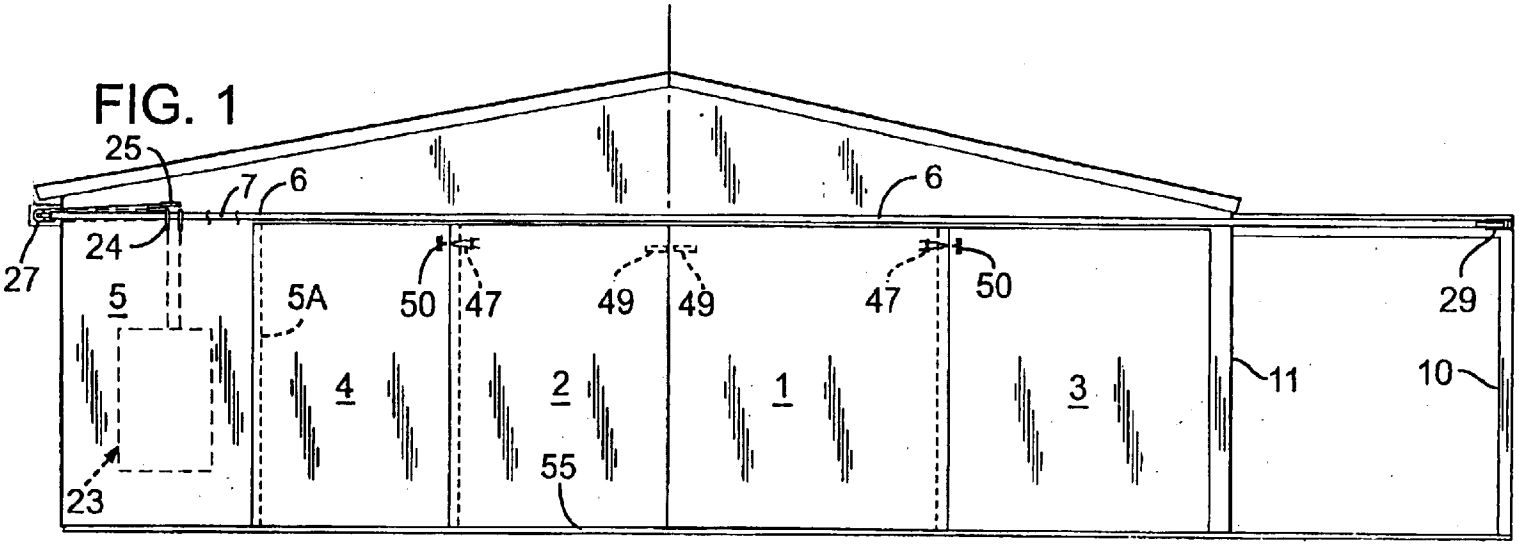
FIG. 1 is a front elevational view of a building with door panels and a drive therefor embodying the present invention.
Figure 2:
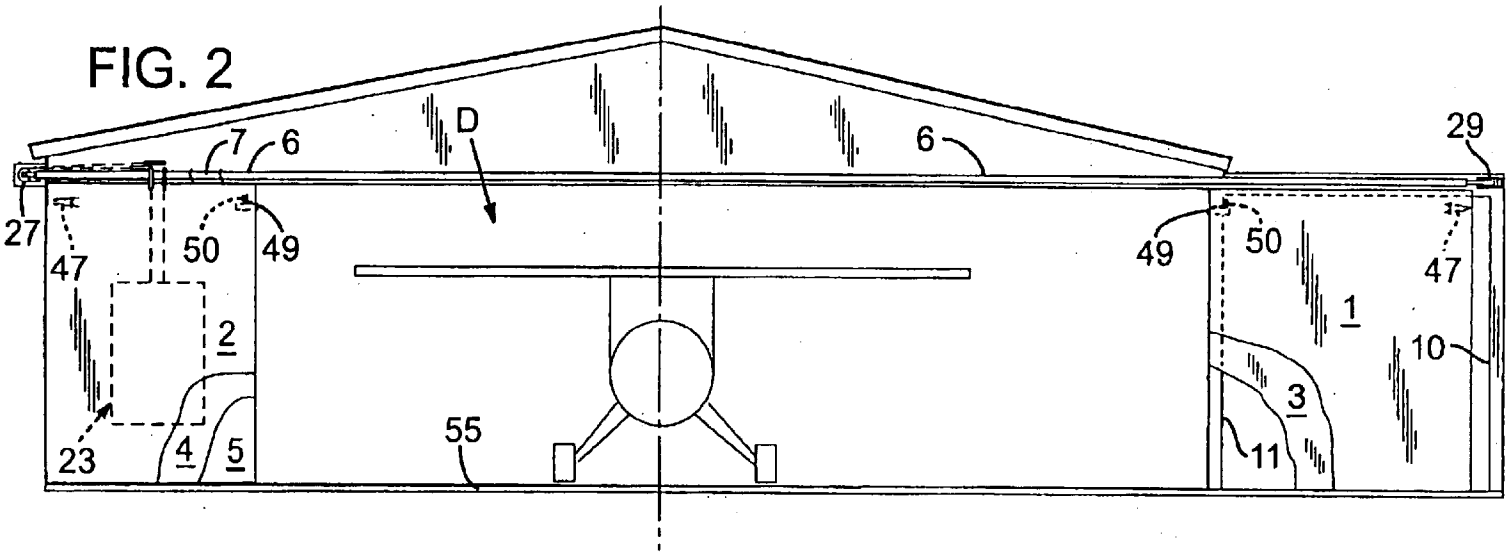
FIG. 2 is a view similar to FIG. 1 but with the door panels stowed at opposite sides of the building.
Figure 5:
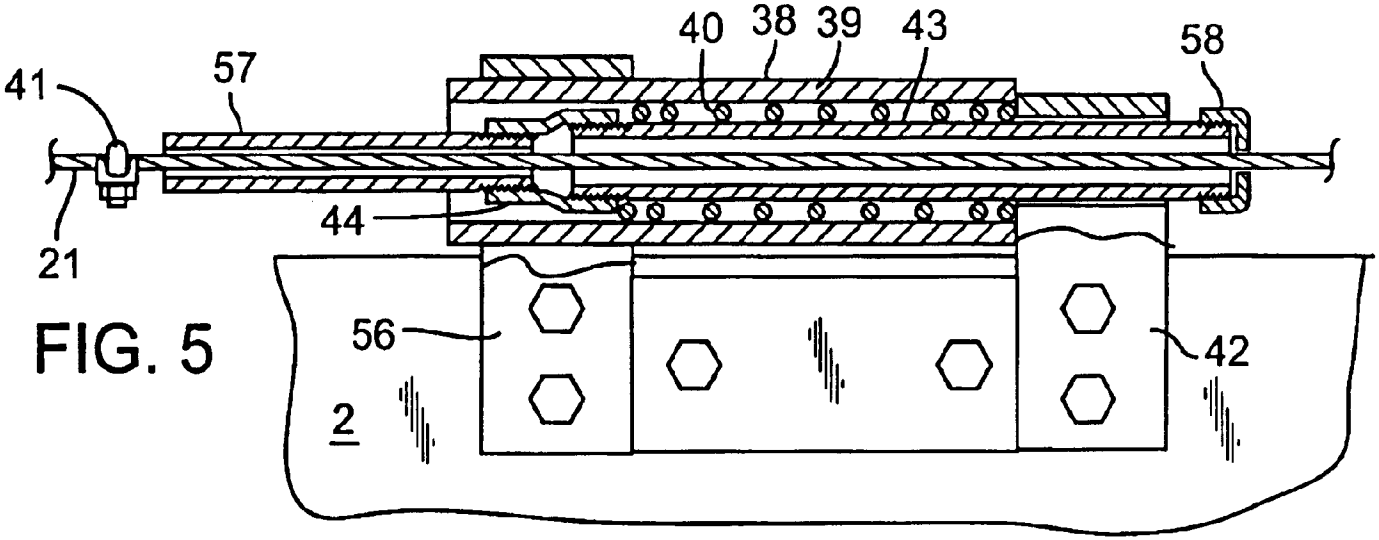
FIG. 5 is a sectional view of one of a pair of stops carried by one of the leading door panels.

With continuing attention to the drawings wherein applied reference numerals indicate parts similarly hereinafter identified, a one story building is shown in FIGS. 1 and 2 of the type utilized for the storage of various large articles such as vehicles, light aircraft, farm equipment, feed, etc. In some parts of the United States the following described building is termed a "pole building" characterized by wooden posts and trusses in frames with exterior walls being of sheet metal which may be ribbed for strength.

A building front wall 5 defines a doorway D closed by a door of multiple panels, 1, 2, 3 and 4. When such buildings are used primarily as airplane hangers the panels 1, 2, 3 and 4 frequently will not be of uniform width nor of uniform travel. Partial front wall 5 of the building serves to support a later described power source for driving of the panels. The panels are suspended from tubular parallel tracks 6 and 7.

Panels 2 and 4 comprise a first set of panels while panels 1 and 3 a second set with leading panels 1 and 2 carried by outermost track 6 (with respect to front wall 5) and second track 7 serves to carry trailing panels 3 and 4. When fully open the leading panel of each set, i.e., panels 1 and 2 will overlie tailing panels 3 and 4 on tracks 6 and 7. An extension of the tracks on a framework 10 protrudes beyond one side 11 of the building.

Vertical edge 5A of the front wall and a building side wall 11 define doorway D which may be of a width of 40 feet or so. Panel bottom edges are confined for linear travel as later described.

In the following described drive components are installed on wooden frame members on the interior of the panels and wall 5.

On the interior side of building front wall 5 is a motor 14 and a reduction drive generally at 23 for a double cable drum at 15. Accordingly, motor 14 having a reversible output shaft imparts rotation to double drum 15 at a greatly reduced speed to simultaneously retrieve and pay out cables at 21 and 22 or vice verse from double drum 15. A frame at 17 for the drive components noted may move vertically along parallel wall mounted members 18 with the frame slidably retained by angular clips as at 20. Frame 17 may be secured in place on the upright members 18 by means of a locking pin or oppositely permitted to move in response to varying tension on flexible drive members shown as cable 21 or 22 during door panel travel. Each cable 21 and 22 is re-directed to the horizontal by cooperating pairs of pulleys at 24 and 25 rotatably affixed to building front wall 5 to laterally space apart the cables for entrainment about pulleys 27 and 28.

Figure 6:
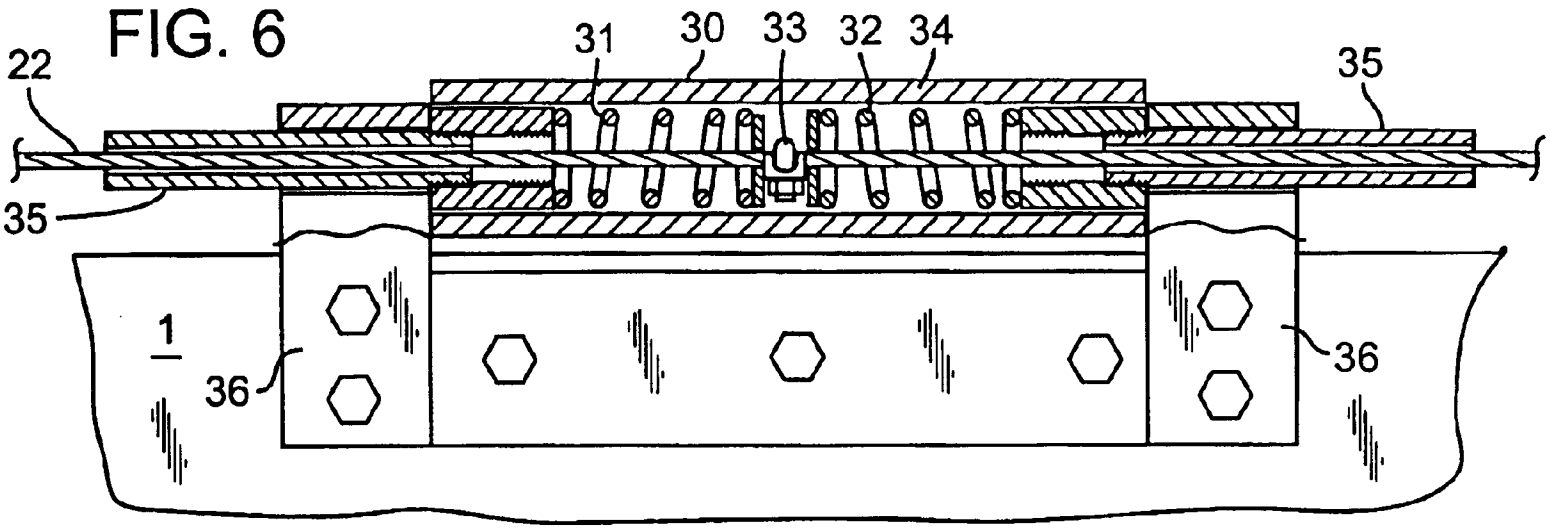
FIG. 6 is a sectional view of a stop in place on a remaining leading door panel.

With further attention to FIG. 3, and for purposes of explanation, cables 21 and 22 are a single cable that is reversed by passage around pulley 29 at the far end of framework 10. For descriptive purposes cables 21 and 22 will be designated as run 21 and run 22 with. With continuing attention to FIG. 3 and FIG. 6, it will be seen that a stop at 30 on panel 1 includes resilient components 31, 32 in a tubular housing 34 to cushion loads alternately imparted by a clamp 33 on run 22.

Accordingly, initial movement of leading panel 1 in the direction of the arrow in FIG. 3 will coincide with initial movement of cable run 22. Tubular cable guides are at 35 with mounting brackets at 36.

The first set leading panel at 2 has a pair of horizontally spaced apart stops 37 and 38 located adjacent panel vertical edges 2A and 2B. Opening movement of first set leading panel 2 is delayed, in view of a panel activating clamp 41 on run 21 traversing the distance between stop 37 and stop 38. Accordingly the panel first set and the panel second set of panels will reach their respective full open, juxtaposed stowed positions simultaneously. Clamp 41 is settable along cable run 21 to delay as needed the start of travel of panels 2 and 4. Stop 37 is a mirror image of stop 38 with the stops having a housing 39 and a compression spring 40 confined at one end by a panel mounted bracket 42. A pipe segment at 43 carries a pipe reducer 44. A second bracket 56 supports housing 39 with a tubular extension 57, of a soft metal, e.g., copper, engageable at its free end by clamp 41 on run 21. A cap 58 is apertured and beveled and of a soft metal to reduce abrasive contact with the cable run.

Panel Latch Mechanism

Figure 7:
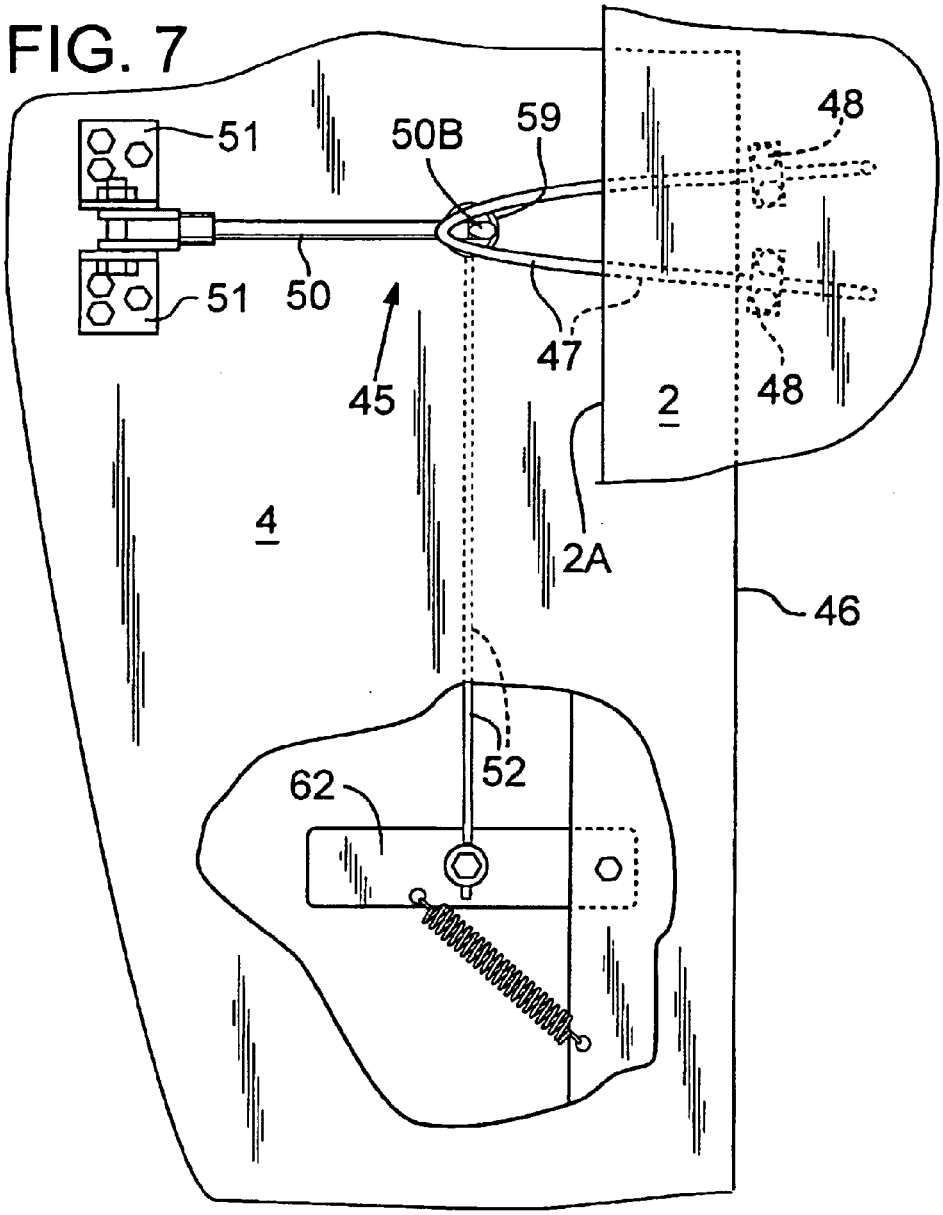
FIG. 7 is a view of that door construction encircled at 7 in FIG. 3.
Figure 8:
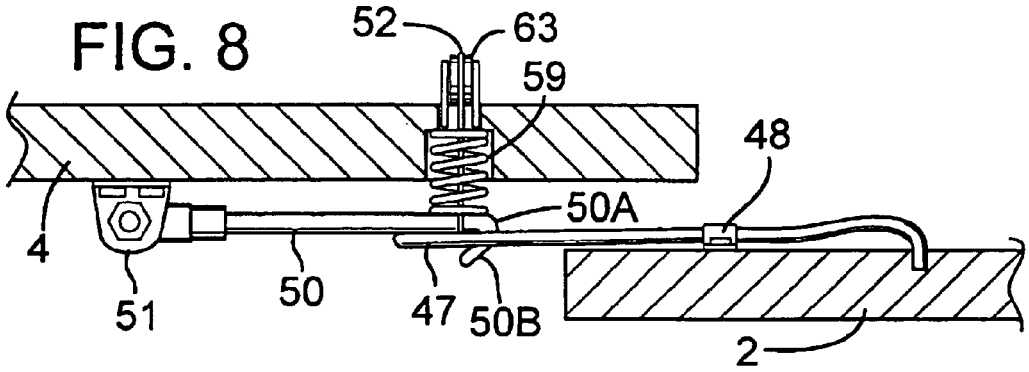
FIG. 8 is a plan view of FIG. 7.
Figure 10:
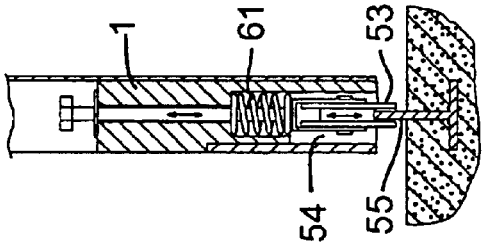
FIG. 10 is a sectional view taken along line 10—10 of FIG. 9.

With continuing attention to FIG. 3 and FIG. 7, a latch mechanism mechanisms indicated generally at 45 serve to return a trailing panel from its stowed position to a doorway closing position whereat a typical panel edge 46 overlies an edge of an adjacent panel 2. Prior panel travel to a stowed position is by a bracket 49 on panel 2 panels 1 and 2 advancing into contact with a panel edge as at 46.

A bail at 47 of each latching mechanism 45 for example is carried by the inner surface of panel 2 and projects horizontally from its retainers at 48 for cooperation with a latch 50 located on the frontal surface of trailing panel 4. During door opening travel of panel 2, bail 47 will flex upon contact with latch 50 allowing passage of the bail. During return travel of panel 2 in the opposite direction, latching mechanism 45 serves to couple the panels 2 and 4. Latch 50 is mounted on the frontal surface of panel 4 by a pair of angular brackets 51, which allow the latch to retract in response to the passage of bail 47 during initial movement of panel 2 toward a stowed position. Latch 50 terminates in a distal end segment somewhat reversed to form a hook 50A. During initial opening movement of panel 2 bail 47 slidably engages an inclined surface 50B to enable bail passage past latch 50. After passage of bail 47, latch 50 being spring biased at 59 automatically repositions itself away from frontal surface of panel 4 and back into the return path of bail 47 to engage same during later doorway closing movement of panel 2. Bail 47, after engagement with latch 50, in effect pulls panel 4 into its doorway closing position as shown in FIG. 3. The same sequence occurs in the opening and closing of the second set of panels 1 and 3.

For singular opening of trailing panel 3 or 4 the following is applicable. For example, panel 4 is unlatched from its leading panel 2 and bail 47 thereon by actuation of a lever 62 pivotally mounted on panel 4 which retracts a control wire 52 entrained about a panel mounted pulley wheel 63 to retract latch 50 back toward the frontal surface of panel 4. Panel 4 is then free to be manually opened, either partially or fully to a stowed position forward of building wall 5.

The foregoing is explanatory of a latching mechanism operable to couple panels 2 and 4 and 1 and 3 during normal doorway closing travel with latch 50 also being selectively positionable to permit independent manual positioning of either or both trailing panels 3 and 4. Trailing panels 3 and 4 are of a size and weight permitting manual positioning. When trailing panel 3 or 4 or both are manually returned to a doorway closing position the trailing panels are locked against manual displacement by bail 47.

Figure 9:
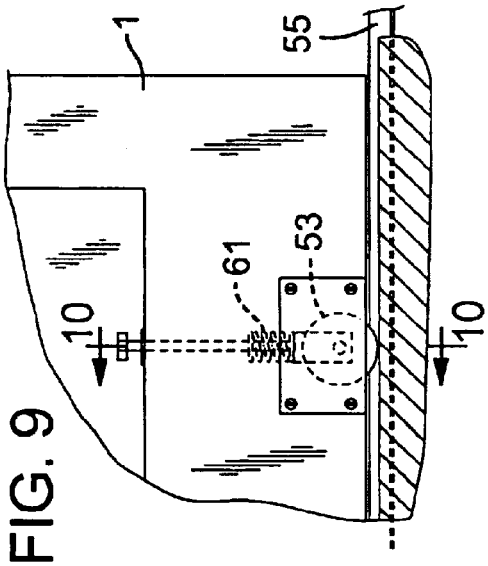
FIG. 9 is a fragmentary elevational view of the lower portion of a door panel and wheel carried thereby.

As typically shown in FIG. 9, the lowermost edges of panels 1 through 4 carry pairs of wheels 53 recessed within cavities 54 in the bottom of each panel. Each wheel has a grooved perimeter for entrainment on a rail as at 55 extending lengthwise of the building doorway. Such wheel entrainment prevents lateral dislodgment of the panels inward into doorway D by wind gusts or accidental contact by a moving object. Preferably the door carried wheels are lightly biased at 61 into rail engagement as the wheels serve only to prevent inward displacement of the doors with door weight supported by earlier described trolleys in tracks 6 and 7.

Figure 11:
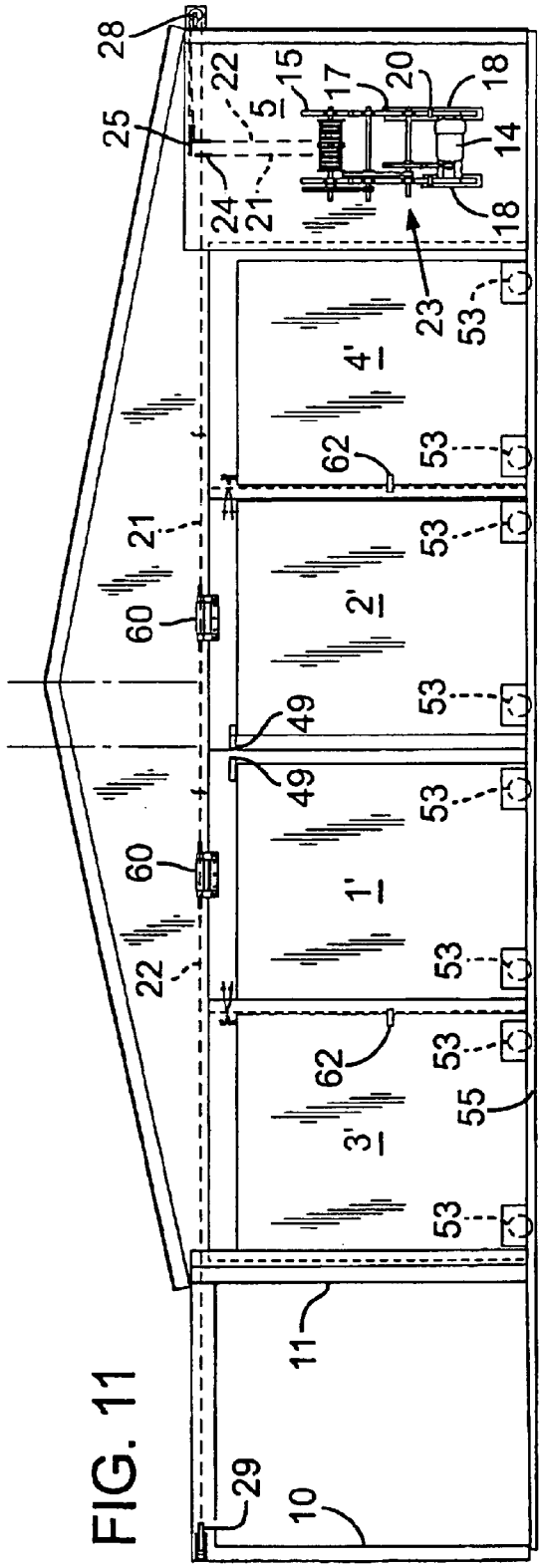
FIG. 11 is a view similar to FIG. 3 but showing first and second sets of door panels of uniform width positionable by a modified form of the present drive.

In a second form of the drive shown in FIG. 11, the leading and trailing panels of each set of a building door are of the same width and travel to permit dispensing with the delay feature of the earlier described preferred form of the invention. Leading doors 1' and 2' of the modified drive are each equipped with a stop at 60 of the type earlier identified as stop 30 wherein a cable clamp is located between a pair of oppositely disposed resilient members.

The operation of the drive for the sets of door panels is believed apparent upon an understanding of the foregoing description. A motor control initiates opening and closing of the door panels with leading panels 1 and 2 of the sets, equipped with right angular brackets as at 49, moving into contact with a panel edge as at 46 of a trailing panel. Opening movement of the panels terminates upon the motor circuit being opened by actuation of a microswitch upon leading panel 2 reaching its stowed position. The remaining leading and trailing panels will have coincidentally reached their stowed positions. Closing of the panels occurs upon an operator activating an override switch completing a circuit to the motor for reverse motor operation which terminates upon opening of a microswitch located in the closing path of a leading panel. If so desired, the use of limit switches as above noted may be dispensed with upon use of a motor having a settable control for timed periods of motor operation in both directions.

While I have shown but a few embodiments of the invention, it will be apparent to those skilled in the art that the invention may be embodied still otherwise without departing from the spirit and scope of the claimed invention.

I claim:

1. A door for a building comprising, a first set of panels and a second set of panels normally closing a doorway with each set of panels having a leading panel and a trailing panel, a combined width of said first set of panels different than a combined width of said second set of panels, a motor and a cable drum, a first cable run and a second cable run extending across the doorway, each of said runs having a respective panel actuating clamp thereon, said leading panel of said first set having a pair of stops with said stops horizontally spaced apart and receiving said first cable run with the first cable run panel actuating clamp located between the pair of stops, said leading panel of said second set having a stop thereon housing the panel actuating clamp of said second cable run, said leading panel of said first set moving in a delayed fashion and subsequent to initiation of travel of said first cable run, said leading panel of said second set of panels moving coincident with movement of the second cable run, said leading panel and said trailing panel of said first set and said leading panel and said trailing panel of said second set reaching their respective stowed locations adjacent sides of the doorway simultaneously.

2. The door claimed in claim 1 additionally including a latch mechanism coupling the leading panel and the trailing panel of one of said sets of panels, said latch mechanism including a manually operated spring biased latch.

3. The door claimed in claim 2 wherein said latch mechanism includes a flexible bail disposed on one of said panels of said one of said sets of panels for engagement with said latch mechanism.

4. The door claimed in claim 1 additionally including a frame, said motor and cable drum carried by said frame and moveable therewith in response to tensioning of the cable runs during movement of the panels.

5. The door claimed in claim 1 wherein each of said pair of stops includes a compression spring.

6. The door claimed in claim 1 wherein said stop of said second set includes resilient components disposed on opposite sides of the panel actuating clamp of said second cable run.

* * * * *